US010627777B2

(12) United States Patent
Koguchi et al.

(10) Patent No.: US 10,627,777 B2
(45) Date of Patent: Apr. 21, 2020

(54) SEPARATION HOLDING MEMBER, CARTRIDGE UNIT, AND PACKAGING BODY

(71) Applicant: CANON KABUSHIKI KAISHA, Tokyo (JP)

(72) Inventors: Kohei Koguchi, Yokohama (JP); Yoichiro Iizuka, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/253,415

(22) Filed: Jan. 22, 2019

(65) Prior Publication Data

US 2019/0227482 A1 Jul. 25, 2019

(30) Foreign Application Priority Data

Jan. 23, 2018 (JP) ..... 2018-008712

(51) Int. Cl.
*G03G 21/18* (2006.01)
*G03G 21/16* (2006.01)

(52) U.S. Cl.
CPC ..... *G03G 21/1825* (2013.01); *G03G 21/1647* (2013.01); *G03G 2221/1861* (2013.01)

(58) Field of Classification Search
CPC ..... G03G 21/1825; G03G 21/181; G03G 2221/1861; G03G 2215/088; G03G 2215/0877; G03G 2215/0875; G03G 21/1842
See application file for complete search history.

(56) References Cited

U.S. PATENT DOCUMENTS

| | | | | |
|---|---|---|---|---|
| 6,947,686 | B2 | 9/2005 | Kawai et al. | |
| 7,272,339 | B2 | 9/2007 | Tsuzuki et al. | |
| 7,813,668 | B2 | 10/2010 | Ueno et al. | |
| 8,208,830 | B2 | 6/2012 | Uratani et al. | |
| 2007/0160388 | A1* | 7/2007 | Yoshimura ..... | G03G 21/1825 399/111 |

FOREIGN PATENT DOCUMENTS

| | | | |
|---|---|---|---|
| JP | 2003241621 | A | 8/2003 |
| JP | 2006308755 | A | 11/2006 |
| JP | 2006330427 | A | 12/2006 |
| JP | 2008262088 | A | 10/2008 |
| JP | 2009031507 | A | 2/2009 |
| JP | 2016110134 | A | 6/2016 |

* cited by examiner

*Primary Examiner* — Sevan A Aydin
(74) *Attorney, Agent, or Firm* — Rossi, Kimms & McDowell LLP

(57) ABSTRACT

The separation holding member 36 includes a grip portion **36*h* for detaching the separation holding member 36 from the cartridge B, the grip portion 36*h* being configured so as to assume a first shape of protruding in a direction of separation from a surface of the cartridge B when the cartridge B mounted with the separation holding member 36 is detached from the apparatus main body A and to assume a second shape in which a gap with the surface of the cartridge B is smaller than in the first shape when the cartridge B mounted with the separation holding member 36** is mounted to the apparatus main body A.

11 Claims, 12 Drawing Sheets

SEPARATION HOLDING MEMBER, CARTRIDGE UNIT, AND PACKAGING BODY

BACKGROUND OF THE INVENTION

Field of the Invention

The present invention relates to a separation holding member used in a cartridge of an electrophotographic image forming apparatus.

Description of the Related Art

As systems for transferring a developer from a developer bearing member to an image bearing member (developing a latent image) in process means of an electrophotographic image forming apparatus (hereinafter, an image forming apparatus) such as a copier or a printer, a contact developing system and a non-contact developing system are known. In the contact developing system, developing is performed by bringing the image bearing member and the developer bearing member in contact with each other. In the non-contact developing system, developing is performed while holding a minute clearance between the image bearing member and the developer bearing member. Cartridge-system image forming apparatuses are known in which the process means is integrated as a cartridge that is attachable to and detachable from an image forming apparatus main body. During distribution of a cartridge on an independent basis as well as during distribution of an image forming apparatus in a state where a cartridge is mounted to an apparatus main body, there is a concern that an image bearing member and a developer bearing member being arranged in proximity to or in contact with each other may incur damage due to vibration, impact, and the like during transportation and delivery. In other words, in the contact developing system, since the image bearing member and the developer bearing member are always in pressure contact with each other during transportation and delivery, the developer bearing member may permanently deform so as to follow a surface shape of the image bearing member or rubbing between the image bearing member and the developer bearing member may occur and leave rub marks on the bearing members. In addition, in the non-contact developing system, the cartridge may suffer a big impact during transportation and delivery and, consequently, the image bearing member and the developer bearing member may abut against each other and incur damage. In order to solve such problems, a configuration is known which, at least during transportation and delivery, maintains a relative arrangement of an image bearing member and a developer bearing member to a state where the image bearing member and the developer bearing member are more separated from each other than when performing developing (Japanese Patent Application Laid-open No. 2003-241621). In addition, configurations are known which are provided with a separation holding member for holding an image bearing member provided in a cartridge and transfer means that is process means provided in an apparatus main body in an separated state when the cartridge is mounted inside the apparatus main body during transportation and delivery (Japanese Patent Application Laid-open No. 2009-31507, Japanese Patent Application Laid-open No. 2008-262088).

SUMMARY OF THE INVENTION

Although separation holding members such as that described above are removed when using an image forming apparatus and are not a component provided in the image forming apparatus during use, due to demands for reduced apparatus size, further downsizing of separation holding members is required in a similar manner to other components of the image forming apparatus. The separation holding member is provided in a gap between a cartridge and an apparatus main body in order to protect an image bearing member, process means, and a storage element from damage due to impact applied during transportation and delivery when the cartridge is packaged and shipped in a state of being mounted inside the apparatus main body. Progress in downsizing of the apparatus main body results in a smaller gap between the cartridge and the apparatus main body. In order to arrange the separation holding member in such a small gap, a configuration in which the separation holding member is arranged so as to follow a shape of the cartridge is conceivable. However, when arranging the separation holding member so as to follow a shape of the cartridge, there is a concern that the separation holding member may become more difficult to grasp and remove when a user attempts to detach the separation holding member after arrival of the apparatus main body.

An object of the present invention is to provide a separation holding member which realizes improved handleability while contributing to downsizing of an image forming apparatus.

To achieve the object described above, the present invention

A separation holding member provided in a cartridge attachable to and detachable from an apparatus main body of an image forming apparatus, the separation holding member being mounted to the cartridge so as to hold a first frame body which supports an image bearing member and a second frame body which supports a developer bearing member at a relative position where the image bearing member and the developer bearing member do not come into contact with each other, the separation holding member including:

a grip portion for detaching the separation holding member from the cartridge, the grip portion being configured so as to assume a first shape of protruding in a direction of separation from a surface of the cartridge when the cartridge mounted with the separation holding member is detached from the apparatus main body, and assume a second shape in which a gap with the surface of the cartridge is smaller than in the first shape when the cartridge mounted with the separation holding member is mounted to the apparatus main body.

To achieve the object described above, the present invention

A cartridge unit attachable to and detachable from an apparatus main body of an image forming apparatus includes:

a cartridge including an image bearing member on which an electrostatic latent image is formed, a developer bearing member which develops the electrostatic latent image formed on the image bearing member with a developer, a first frame body which supports the image bearing member, a second frame body which supports the developer bearing member and which is relatively movable with respect to the first frame body, a biasing member which biases the first frame body and the second frame body so as to relatively move the first frame body and the second frame body from a retracted position where the image bearing member and the developer bearing member do not come into contact with each other to a development-enabled position where the developer bearing member is capable of developing the electrostatic latent image formed on the image bearing member, and a storage element which is capable of coming into contact with a communication contact portion of a communication unit provided in the apparatus main body and communicating with the communication unit; and the separation holding member.

To achieve the object described above, the present invention

A packaging body which enables transportation of an image forming apparatus, the packaging body comprising:

a cartridge including an image bearing member on which an electrostatic latent image is formed, a developer bearing member which develops the electrostatic latent image formed on the image bearing member with a developer, a first frame body which supports the image bearing member, a second frame body which supports the developer bearing member and which is relatively movable with respect to the first frame body, a biasing member which biases the first frame body and the second frame body so as to relatively move the first frame body and the second frame body from a retracted position where the image bearing member and the developer bearing member do not come into contact with each other to a development-enabled position where the developer bearing member is capable of developing the electrostatic latent image formed on the image bearing member, and a storage element;

the separation holding member according to claim 1; and an apparatus main body of the image forming apparatus to/from which the cartridge mounted with the separation holding member is attachable/detachable, the apparatus main body including a transfer member which forms a nip between the image bearing member and the transfer member and which transfers a developer image formed on the image bearing member to a recording material supplied to the nip, a communication unit which is capable of communicating with the storage element via a communication contact portion that comes into contact with the storage element, and an abutment portion which abuts against the grip portion when the cartridge mounted with the separation holding member is mounted to the apparatus main body and which causes the grip portion to change from the first shape to the second shape.

According to the present invention, a separation holding member which realizes improved handleability while contributing to downsizing of an image forming apparatus can be provided.

Further features of the present invention will become apparent from the following description of exemplary embodiments with reference to the attached drawings.

DESCRIPTION OF THE EMBODIMENTS

Figure 1:
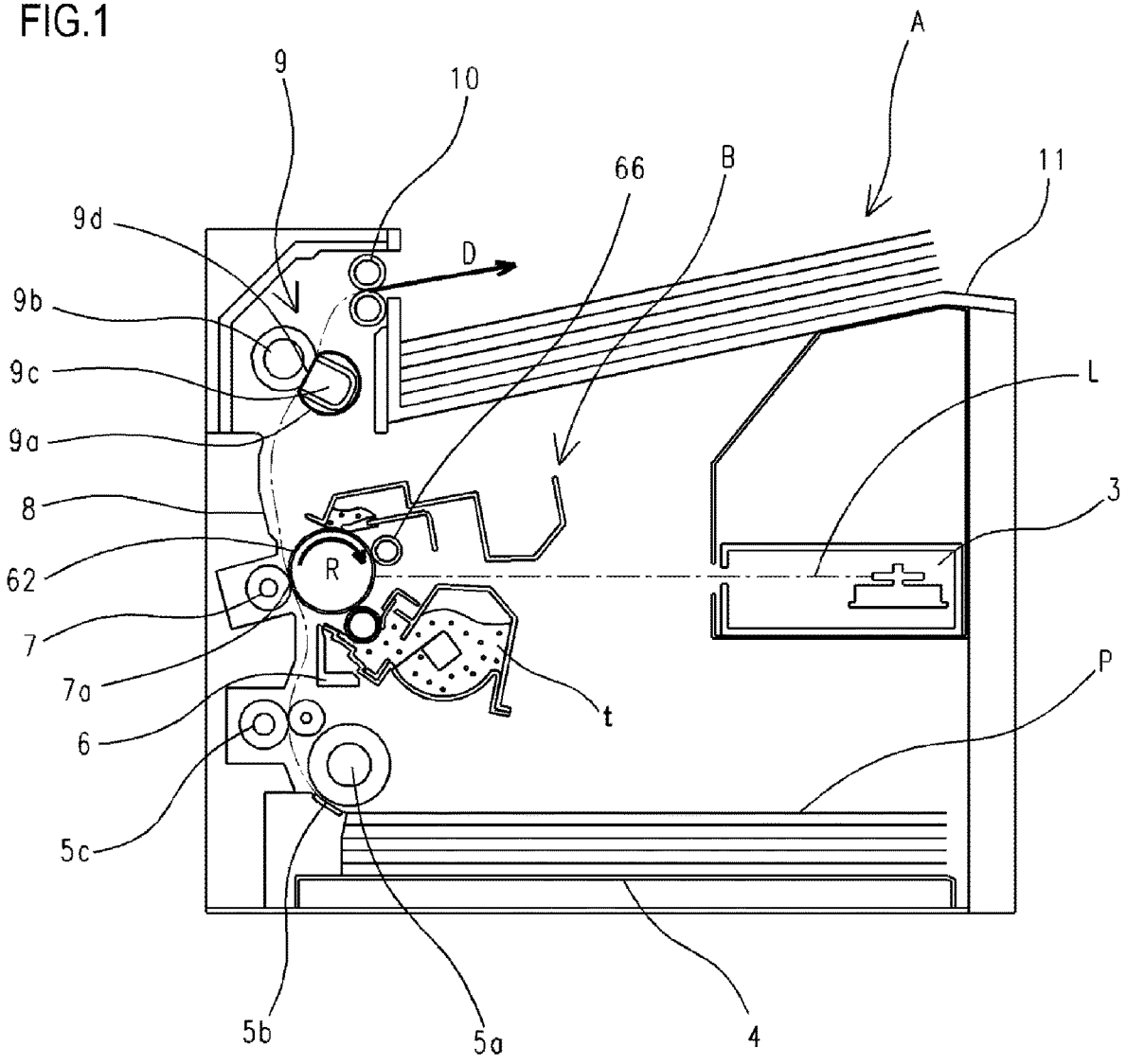
FIG. 1 is a sectional explanatory diagram of an electrophotographic image forming apparatus according to an embodiment of the present invention.

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment

A separation holding member, a cartridge, an image forming apparatus, and a packaging body according to an embodiment of the present invention will now be described.

In this case, a cartridge has at least one of a developer, an image bearing member, and process means that acts on the image bearing member, and the cartridge is attachable to and detachable from an image forming apparatus main body (hereinafter, referred to as an "apparatus main body"). A representative example of a cartridge is a process cartridge. A process cartridge refers to a cartridge which integrates an image bearing member and process means that acts on the image bearing member and which is detachably mounted to an apparatus main body.

In addition, an image forming apparatus refers to an apparatus that forms an image on a recording material (a recording medium) using an electrophotographic image forming system. Examples of an image forming apparatus include an electrophotographic copier, an electrophotographic printer (such as an LED printer or a laser beam printer), a facsimile device, and a word processor. Hereinafter, a laser beam printer main body and a process cartridge attachable to and detachable from the laser beam printer main body will be described as an example of the image forming apparatus according to the present embodiment.

Furthermore, in the embodiment, a cartridge to which a separation holding member is mounted or, in other words, an assembly constituted by the separation holding member and the cartridge will be referred to as a cartridge unit. A cartridge unit refers to an assembly for delivery which is adopted in order to prevent components arranged in proximity to or in contact with each other among the components of the cartridge from incurring damage when delivering (transporting) the cartridge or the like. The assembly configuration enables the cartridge to be delivered in a safe manner.

In addition, in the present embodiment, an image forming apparatus in which a cartridge mounted with a separation holding member is mounted to an apparatus main body or, in other words, an assembly constituted by a separation holding member, a cartridge, and an apparatus main body (components of an image forming apparatus excluding the cartridge) will also be referred to as a packaging body. A packaging body refers to, for example, an assembly for delivery which is adopted in order to prevent components arranged in proximity to or in contact with each other among the components of the apparatus from incurring damage when delivering the image forming apparatus or the like. The assembly configuration enables the image forming apparatus to be delivered in a safe manner.

As specific configurations of the cartridge unit and the packaging body, various configurations are conceivable in accordance with apparatus configuration and the like and are not limited to the configurations described in the present embodiment.

Moreover, in the following description, a longitudinal direction of a process cartridge refers to a direction that is approximately parallel to a rotational axis L0 of a photosensitive drum 62 as an image bearing member and a rotational axis L1 of a developing roller 32 as a developer bearing member (refer to FIG. 4A and FIG. 4B). In addition, the longitudinal direction of the process cartridge is a direction which is substantially perpendicular to a direction in which the process cartridge is attached to and detached from an apparatus main body and which intersects with a transport direction of a recording material. In the longitudinal direction of the process cartridge, a side on which the photosensitive drum 62 receives a rotative force from the apparatus main body is assumed to be a driven side and an opposite side thereof is assumed to be a non-driven side. Furthermore, reference characters in the description are for referring to the drawings and are not intended to limit configurations.

(1) Overall Description of Image Forming Apparatus

An overall configuration of an image forming apparatus according to the embodiment of the present invention will be described with reference to FIG. 1. FIG. 1 is a schematic sectional view illustrating a configuration of the image forming apparatus. The image forming apparatus shown in FIG. 1 forms a developer image on a recording material P using an electrophotographic image forming process in accordance with image information transmitted from an external device such as a personal computer. Examples of the recording material P include recording paper, label paper, OHP sheets, and cloth. In addition, the image forming apparatus is provided with a process cartridge so as to be attachable to and detachable from an apparatus main body by a user. In the following description, a process cartridge will be referred to as a "cartridge B" and an image forming apparatus main body will be referred to as an "apparatus main body A". The apparatus main body A refers to a portion excluding the cartridge B among constituent portions of the image forming apparatus.

Based on a print start signal, the photosensitive drum 62 that is a rotating member is rotationally driven in a direction of an arrow R at a prescribed circumferential speed (a process speed). Due to voltage applied from the apparatus main body A, a surface of the photosensitive drum 62 is uniformly charged by a charging roller 66. The charged photosensitive drum 62 is irradiated by a laser beam L from optical means 3 in accordance with image information, and an electrostatic latent image (an electrostatic image) in accordance with the image information is formed on the photosensitive drum 62. The electrostatic latent image is developed using a developer t by developing means (to be described later) and a developer image is formed on the surface of the photosensitive drum 62. In the apparatus main body A, a paper feeding roller 5*a*, a transporting roller pair 5*c*, a pre-transfer guide 6, a transfer roller 7 as transfer means (a transfer member) of the apparatus main body A, a transport guide 8, a fixing apparatus 9, a discharge roller pair 10, and a discharge tray 11 are sequentially arranged in a transport direction D of the recording material P. In addition, the fixing apparatus 9 is provided with a heating roller 9*a* with a built-in heater 9*c* and a pressure roller 9*b*.

Meanwhile, the recording material P stored in a paper feeding tray 4 is separated and fed one sheet at a time in synchronization with the formation of the developer image described above by the paper feeding roller 5*a* and a separating pad 5*b* in pressure contact with the paper feeding roller 5*a*. Subsequently, the recording material P is fed by the transporting roller pair 5*c*, passes by the pre-transfer guide 6, and supplied to a transfer position between the drum 62 and the transfer roller 7. The transfer roller 7 is biased so as to come into contact with the surface of the photosensitive drum 62. Next, the recording material P passes through a transfer nip portion 7*a* formed by the photosensitive drum 62 and the transfer roller 7. At this point, by subjecting the transfer roller 7 to voltage with a reverse polarity to the developer image, the developer image formed on the surface of the photosensitive drum 62 is transferred to the recording material P. The recording material P onto which the developer image has been transferred is separated from the photosensitive drum 62 and transported to the fixing apparatus 9 along the transport guide 8. Subsequently, heat and pressure are applied to the recording material P when passing through a nip portion 9*d* between the heating roller 9*a* and the pressure roller 9*b*, and the developer image transferred to the recording material P is fixed to the recording material P. As a result, an image is formed on the recording material P. Subsequently, the recording material P is transported to the discharge roller pair 10 and discharged to the discharge tray 11.

(2) Overall Description of Cartridge B

Figure 2:
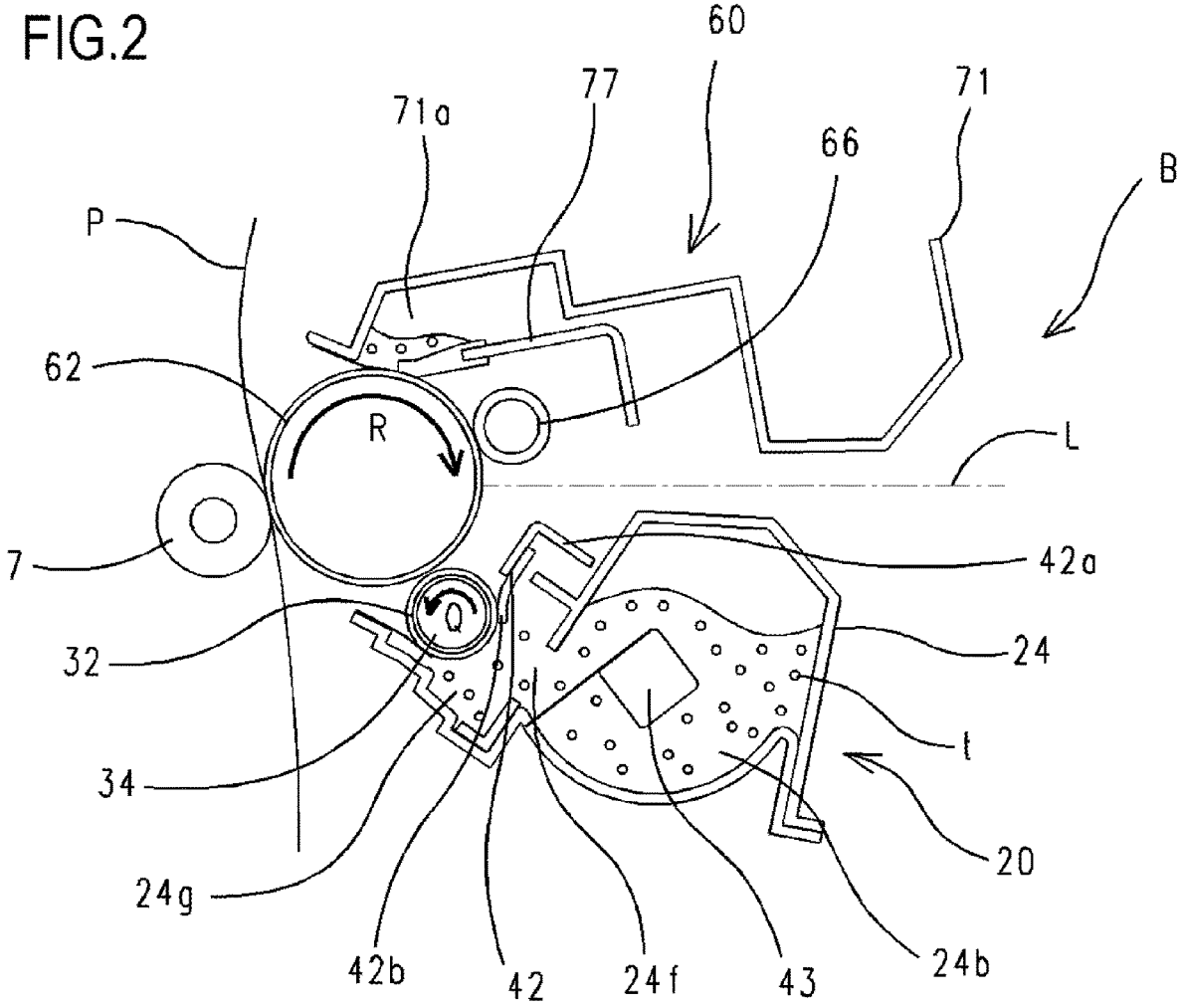
FIG. 2 is a sectional explanatory diagram of a process cartridge according to the embodiment of the present invention.
Figure 3A:
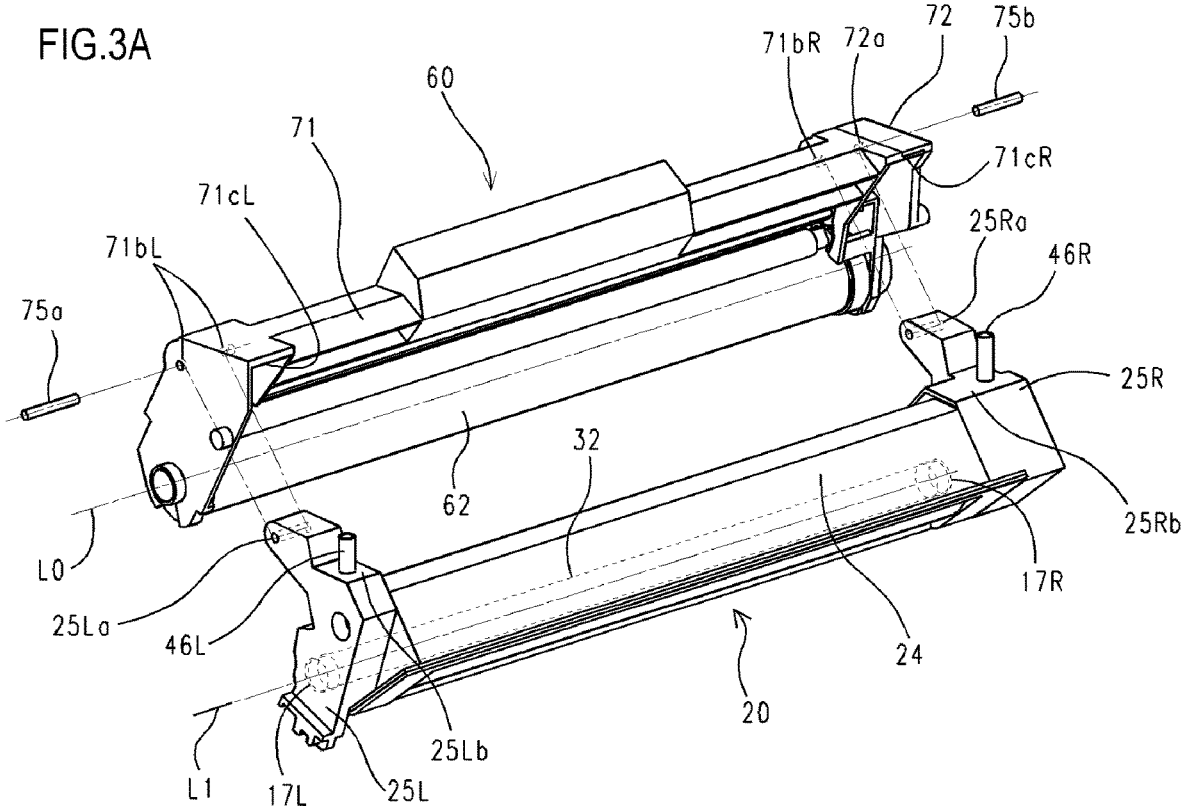
FIG. 3A and FIG. 3B are each a perspective explanatory diagram showing a disassembled state of a process cartridge according to the embodiment of the present invention.
Figure 3B:
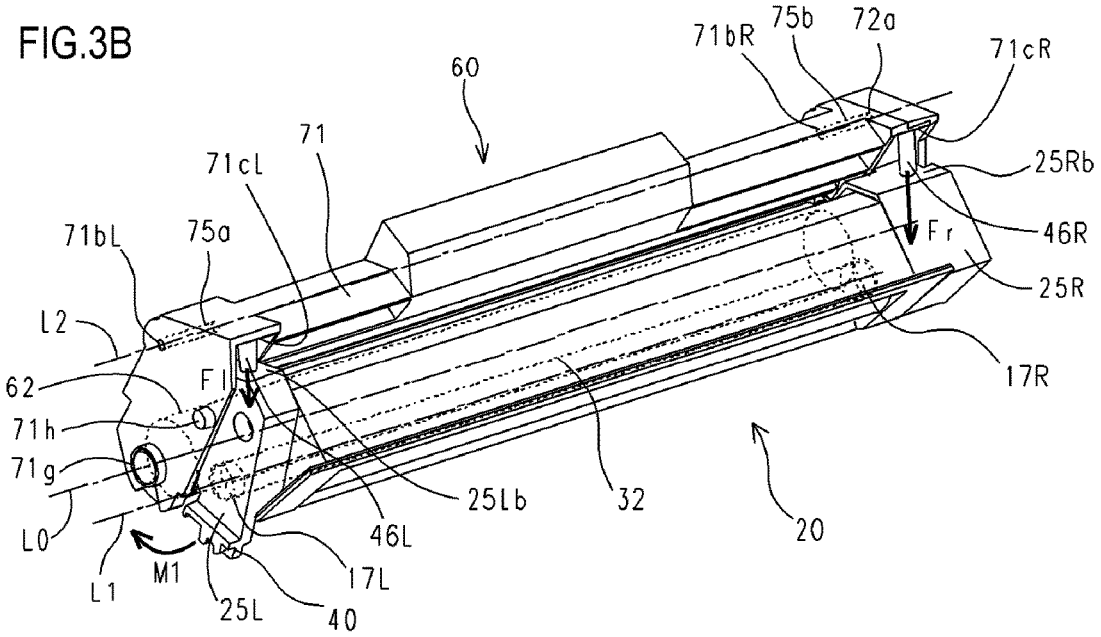
Figure 11A:
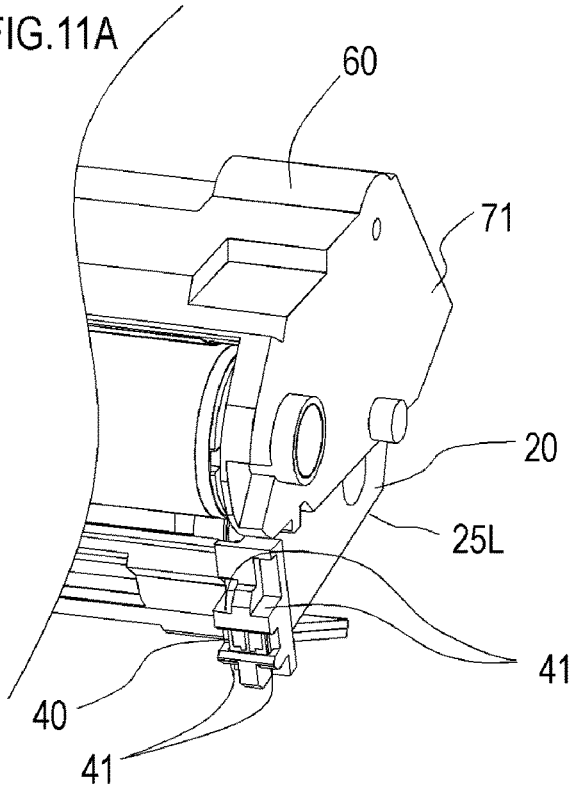
FIG. 11A to FIG. 11C are each an explanatory diagram of a storage element of a cartridge and a communication unit of an apparatus main body.
Figure 11B:
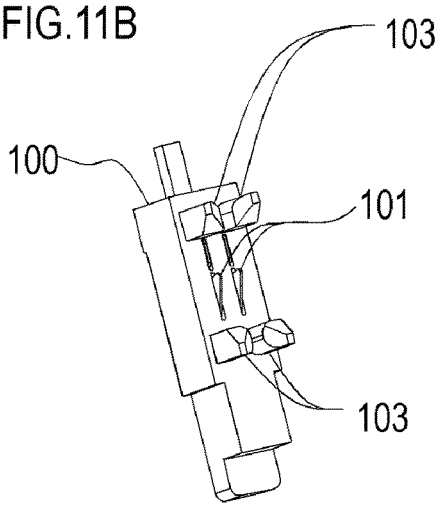
Figure 11C:
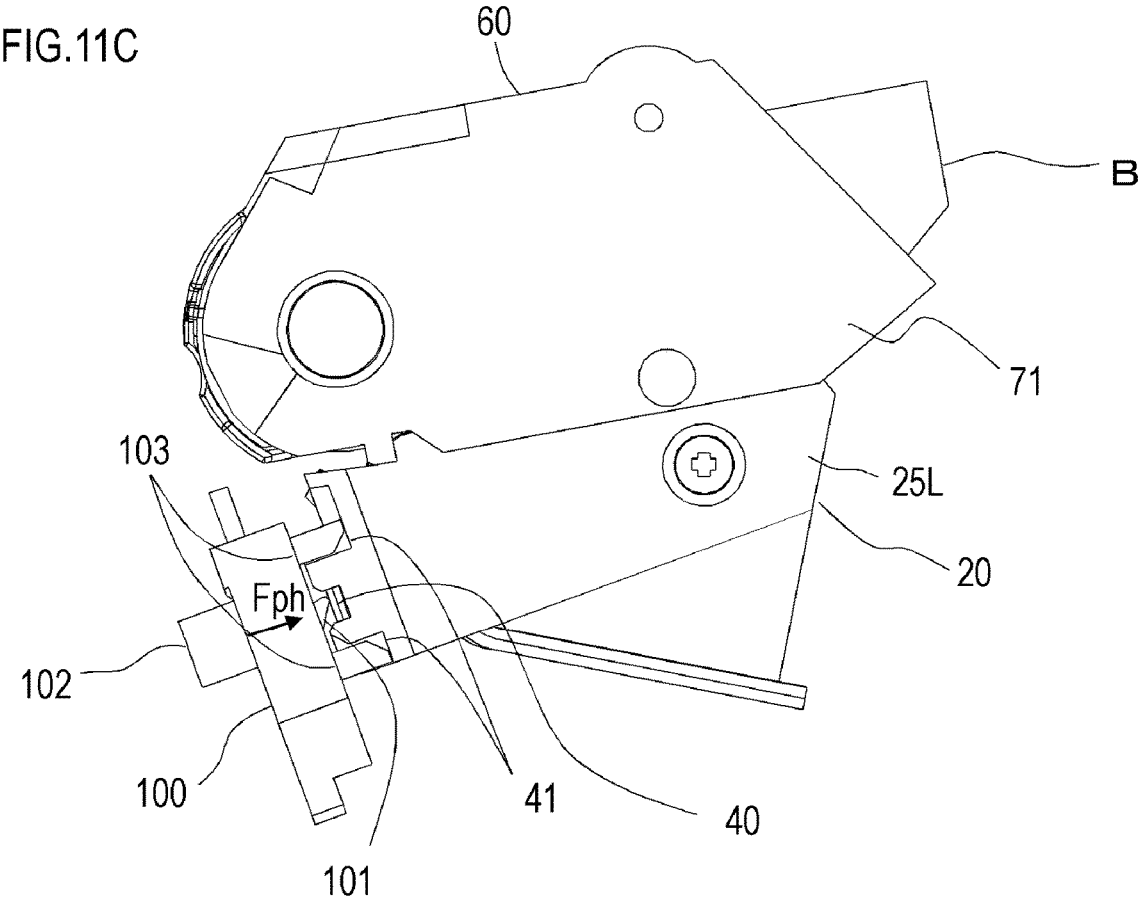

The cartridge B according to the embodiment of the present invention will now be described with reference to FIG. 2, FIGS. 3A and 3B, and FIGS. 11A to 11C. FIG. 2 is a schematic sectional view illustrating a configuration of the cartridge B. FIG. 3A and FIG. 3B are each a schematic perspective view illustrating a configuration of the cartridge B, in which FIG. 3A shows a disassembled state and FIG. 3B shows an assembled state. FIG. 11A is a schematic perspective view illustrating a configuration of a vicinity of a storage apparatus (a storage element) 40 of the cartridge B. FIG. 11B is a schematic perspective view illustrating a configuration of a communication unit 100 provided in the apparatus main body A. FIG. 11C is a schematic view illustrating a state where the storage apparatus 40 and the communication unit 100 are engaged with each other when the cartridge B is mounted to the apparatus main body A.

As shown in FIG. 2, the cartridge B is constituted by a developing unit 20 and a cleaning unit 60. The developing unit 20 is provided with the developing roller 32 and a developing blade 42 as developing means, a developer storage container 24, a side cover 25L, and a side cover 25R configured as the second frame body (refer to FIG. 3A and FIG. 3B), a magnet roller 34, a developer transport member 43, a developer t, and the like. In addition, the cleaning unit 60 is provided with a cleaning frame body 71 as the first frame body, the photosensitive drum 62, a cleaning blade 77, the charging roller 66, and the like.

The developer t stored in the developer storage container 24 is sent into a developing chamber 24*g* from a developer storage portion 24*b* of the developer storage container 24 through a supply opening 24*f* by the developer transport member 43. The developer t in the developing chamber 24*g* is attracted to a surface of the developing roller 32 by a magnetic force of the magnet roller 34 built into the developing roller 32. In addition, the developing blade 42 is constituted by a supporting member 42*a* made of sheet metal and an elastic member 42*b* made of an elastic body such as urethane rubber, and the developing blade 42 is provided so that the elastic member 42*b* comes into elastic contact with the developing roller 32 with a constant contact pressure. Furthermore, by rotating in a rotation direction Q, the developing roller 32 regulates an amount of the developer t which adheres to the surface of the developing roller 32 and applies a triboelectric charge to the developer t. As a result, a developer image is formed on the surface of the developing roller 32. In addition, by rotating, in the rotation direction Q, the developing roller 32 to which voltage is applied from the apparatus main body A, the developer t is supplied to a developing zone of the photosensitive drum 62.

The charging roller 66 is provided in contact with an outer circumferential surface of the photosensitive drum 62 in a state where the charging roller 66 is rotatably supported and biased by the cleaning frame body 71. Due to voltage applied from the apparatus main body A, the charging roller 66 uniformly charges the surface of the photosensitive drum 62. Subsequently, an electrostatic latent image is formed on the surface of the photosensitive drum 62 by the laser beam L of the optical means 3 (refer to FIG. 2). In addition, the developer t is transferred in the developing zone in accordance with the electrostatic latent image of the photosensitive drum 62 to form a developer image on the photosensitive drum 62.

The cleaning blade 77 is provided in elastic contact with the outer circumferential surface of the photosensitive drum 62 and scrapes off the developer t remaining on the photosensitive drum 62 after the developer image is transferred to the recording medium P. The scraped-off developer t is stored in a removed developer storage section 71*a* of the cleaning frame body 71 to which the cleaning blade 77 is fixed.

As shown in FIG. 3A, the cartridge B is constructed by uniting the cleaning unit 60 and the developing unit 20 which are coupled so as to be mutually rotatable by a coupling member 75*a* and a coupling member 75*b*.

Specifically, in the developing unit 20, the side cover 25L and the side cover 25R which rotatably support the developing roller 32 are coupled to both ends in a longitudinal direction (a direction of the rotational axis L1 of the developing roller 32) of the developer storage container 24. In addition, the side cover 25L and the side cover 25R are respectively provided with a rotation hole 25La and a rotation hole 25Ra in parallel to the rotational axis L1 of the developing roller 32, and the rotation hole 25La and the rotation hole 25Ra are arranged coaxially with each other.

Meanwhile, in the cleaning unit 60, a holder 72 which rotatably supports the photosensitive drum 62 is coupled to an end in a longitudinal direction of the cleaning frame body 71. In addition, the cleaning frame body 71 and the holder 72 are respectively provided with a fit-in hole 71*b*L and a fitting hole 71*b*R, and a fitting hole 72*a*, in parallel to the rotational axis L0 of the photosensitive drum 62, and the fit-in hole 71*b*L the fitting hole 71*b*R, and the fitting hole 72*a* are arranged coaxially with each other. Furthermore, the developing unit 20 is set to a prescribed position with respect to the cleaning unit 60 so that the rotation hole 25La and the fit-in hole 71*b*L match each other and the rotation hole 25Ra and the fitting hole 71*b*R and the fitting hole 72R match each other. Subsequently, the coupling member 75*a* is inserted into the fit-in hole 71*b*L and the rotation hole 25La and the coupling member 75*b* is inserted into the fitting hole 71*b*R, the fitting hole 72*a*, and the rotation hole 25Ra. Accordingly, the cleaning unit 60 and the developing unit 20 are coupled so as to be rotatable (relatively movable) around an axis L2 of the coupling member 75*a* and the coupling member 75*b*.

A biasing member 46L and a biasing member 46R are respectively attached to an attaching portion 25Lb of the side cover 25L and an attaching portion 25Rb of the side cover 25R. The biasing member 46L is a compression spring which is compressed between the attaching portion 25Lb of the side cover 25L and a spring abutment portion 71*c*L of the cleaning frame body 71 as shown in FIG. 3B. In a similar manner, the biasing member 46R is compressed between the attaching portion 25Rb of the side cover 25R and a spring abutment portion 71*c*R of the cleaning frame body 71. In addition, due to a biasing force F1 of the biasing member 46L and a biasing force Fr of the biasing member 46R, the developing unit 20 is biased with respect to the cleaning unit 60 by a rotational moment which is oriented in a direction of an arrow M1 and which is centered on the axis L2 of the coupling member 75*a* and the coupling member 75*b*. Furthermore, due to an interval holding member 17L and an interval holding member 17R attached to both ends of the developing roller 32 abutting against the surface of the photosensitive drum 62, the developing roller 32 is arranged at a prescribed interval (a development-enabled position) from the photosensitive drum 62. Accordingly, during image formation, the developing roller 32 is held at a prescribed interval from the photosensitive drum 62 in a state where the developing roller 32 is reliably biased with respect to the photosensitive drum 62.

As shown in FIG. 11A, in the cartridge B, the storage element 40 is arranged on an outer surface of the side cover 25L and electrically connected to the apparatus main body A to enable information to be mutually communicated. The communication unit 100 shown in FIG. 11B is arranged in the apparatus main body A. The communication unit 100 is provided with a contact portion 101 for performing electrical connection with the storage element 40 and a projected portion 103. In a state where the cartridge B is mounted to the apparatus main body A, the projected portion 103 engages a guiding portion 41 arranged in a vicinity of the storage element 40 to position the communication unit 100. The communication unit 100 is provided in the apparatus main body A so as to be biased in a direction of Fph by a biasing member 102 and causes the storage element 40 and the contact portion 101 to come into contact with each other. The storage element 40 stores information specific to the cartridge B such as a history of use and a remaining toner amount of the cartridge B, and the information is used to control an image forming operation.

When the cartridge B is packaged and shipped in a state of being mounted inside the apparatus main body A, a non-driven side separation holding member 36 and a driven side separation holding member 37 are mounted in order to protect process means such as the photosensitive drum 62 and the storage element 40 from damage due to impact applied during transportation and delivery.

(3) Description of Separation Holding Portions (Non-driven Side Separation Holding Member 36 and Driven Side Separation Holding Member 37)

Figure 5A:
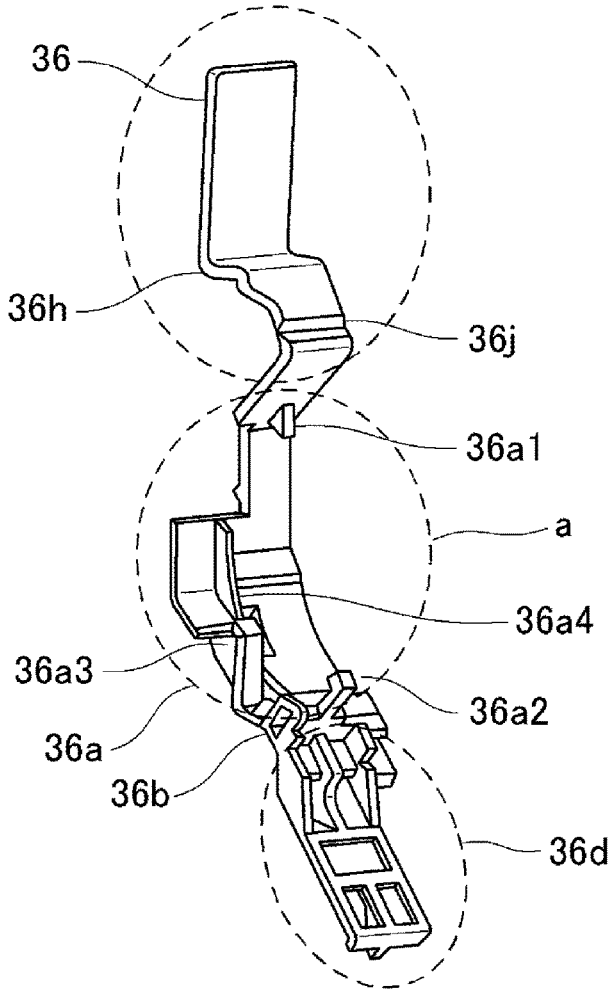
FIG. 5A and FIG. 5B are each an explanatory diagram of a separation holding member according to the embodiment of the present invention.
Figure 5B:
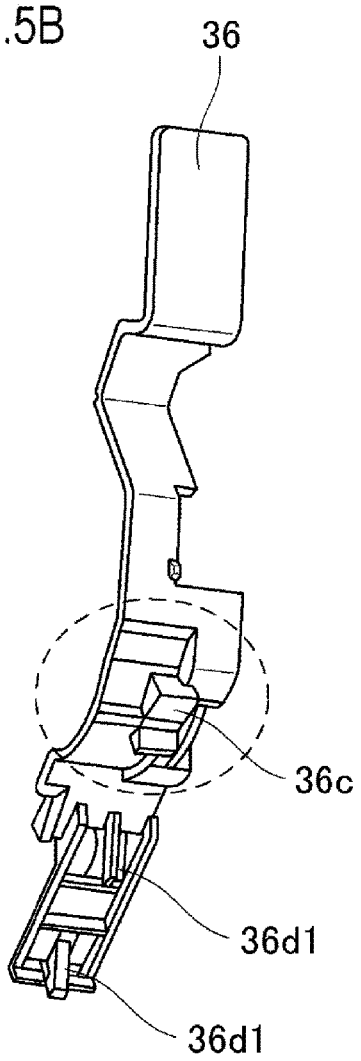
Figure 6:
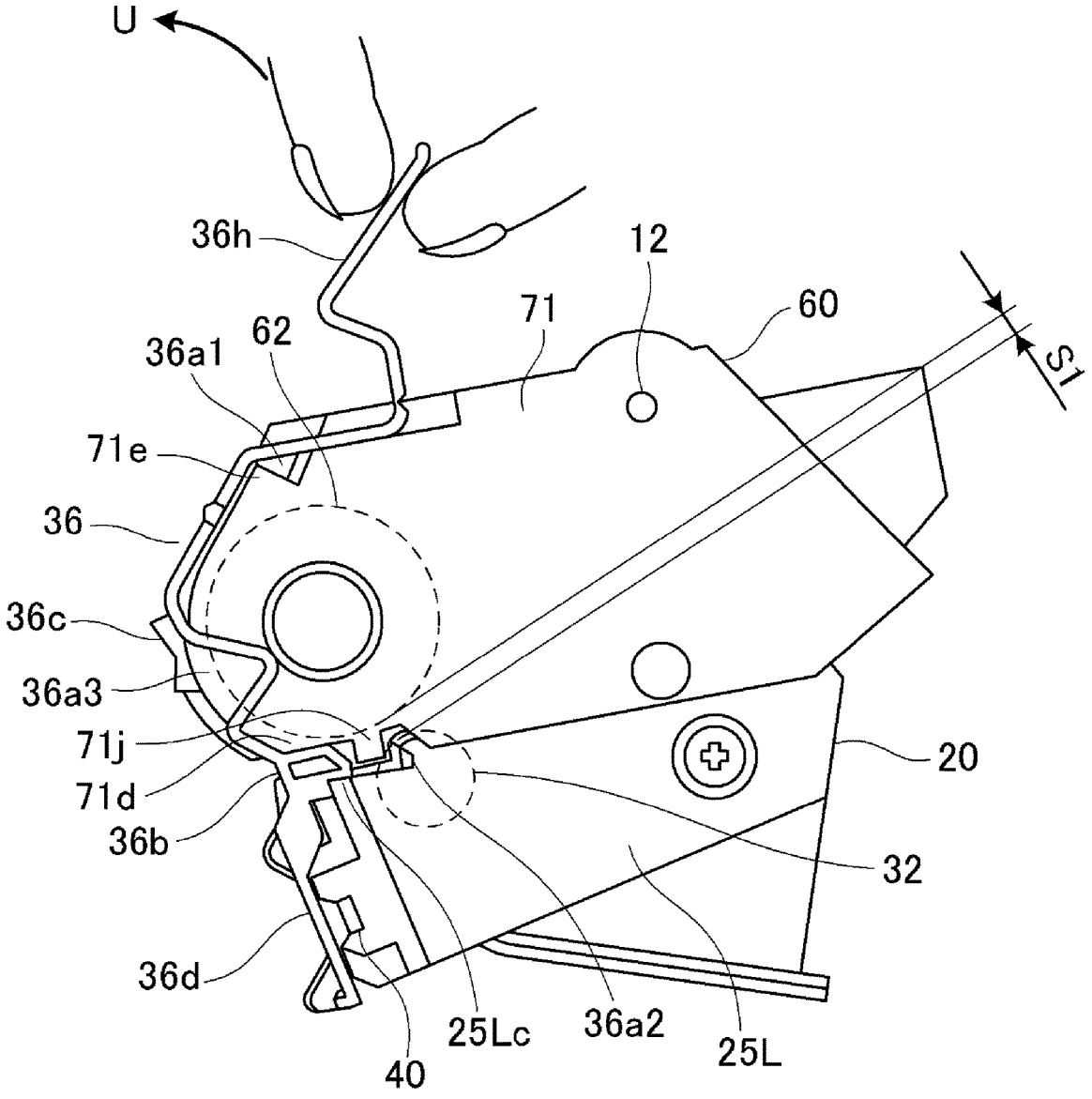
FIG. 6 is an explanatory diagram of a separation holding member and a cartridge unit according to the embodiment of the present invention.
Figure 7:
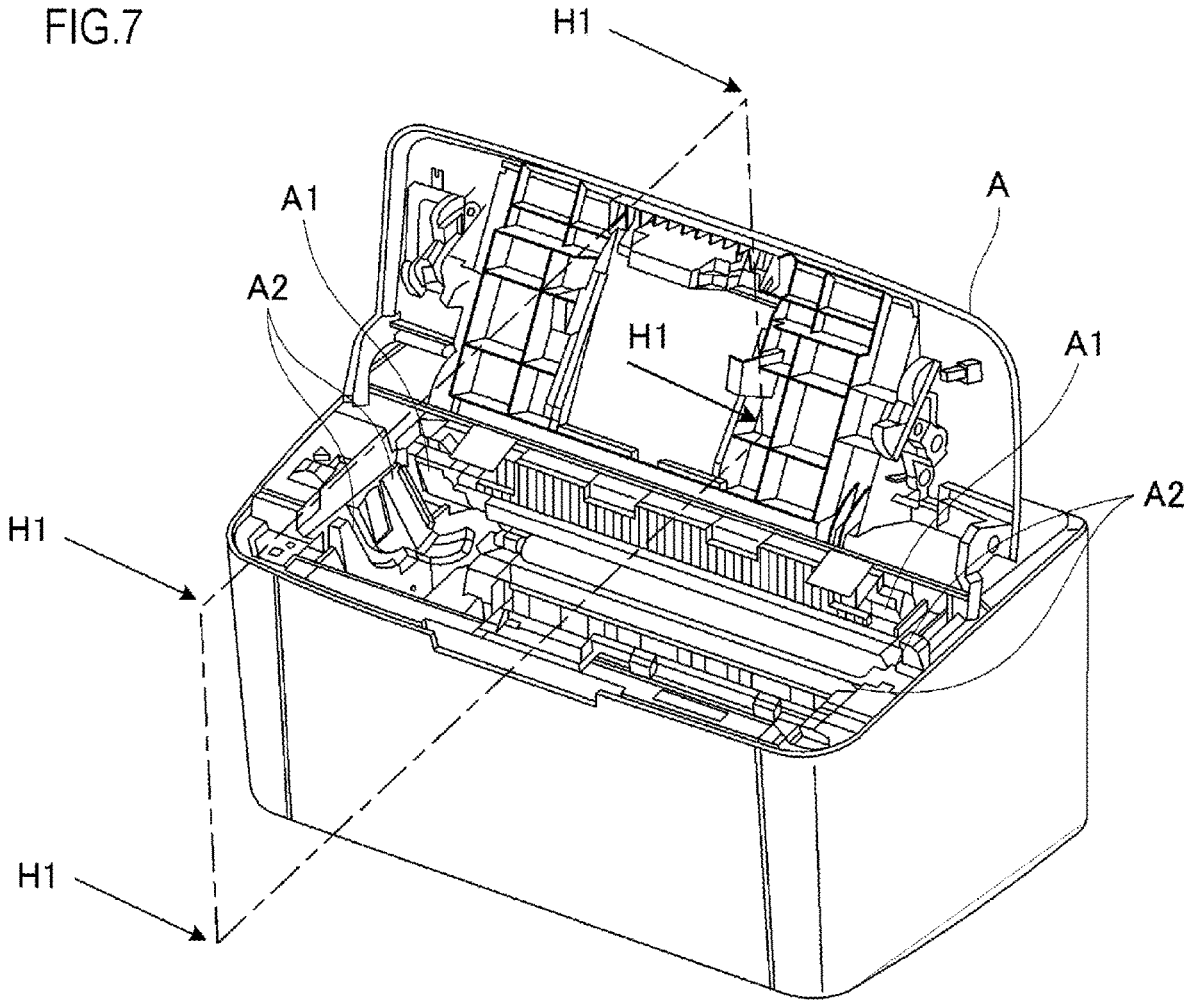
FIG. 7 is a perspective explanatory diagram of an electrophotographic image forming apparatus according to the embodiment of the present invention.
Figure 8:
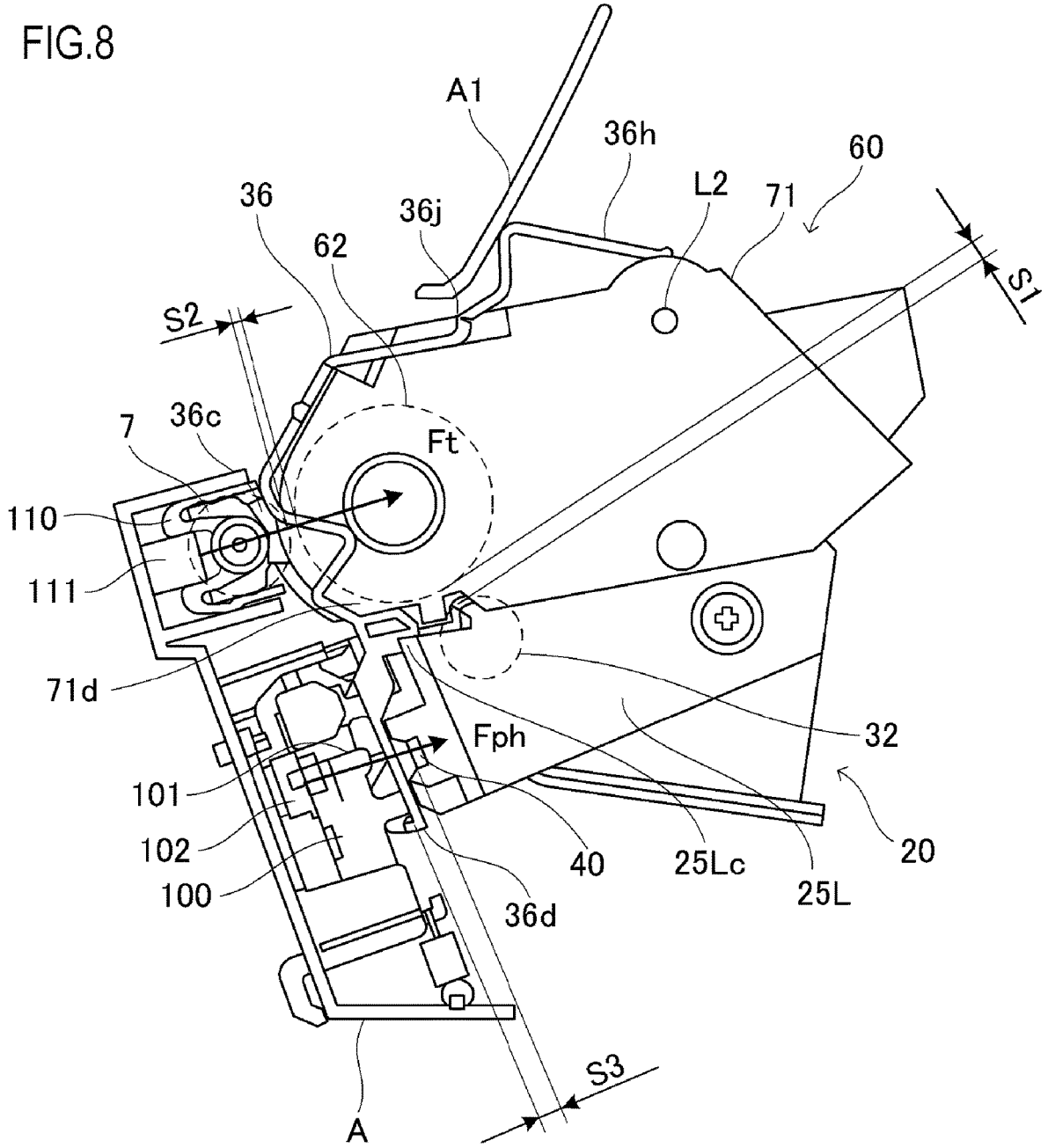
FIG. 8 is an explanatory diagram of a separation holding member and a packaging body according to the embodiment of the present invention.
Figure 9B:
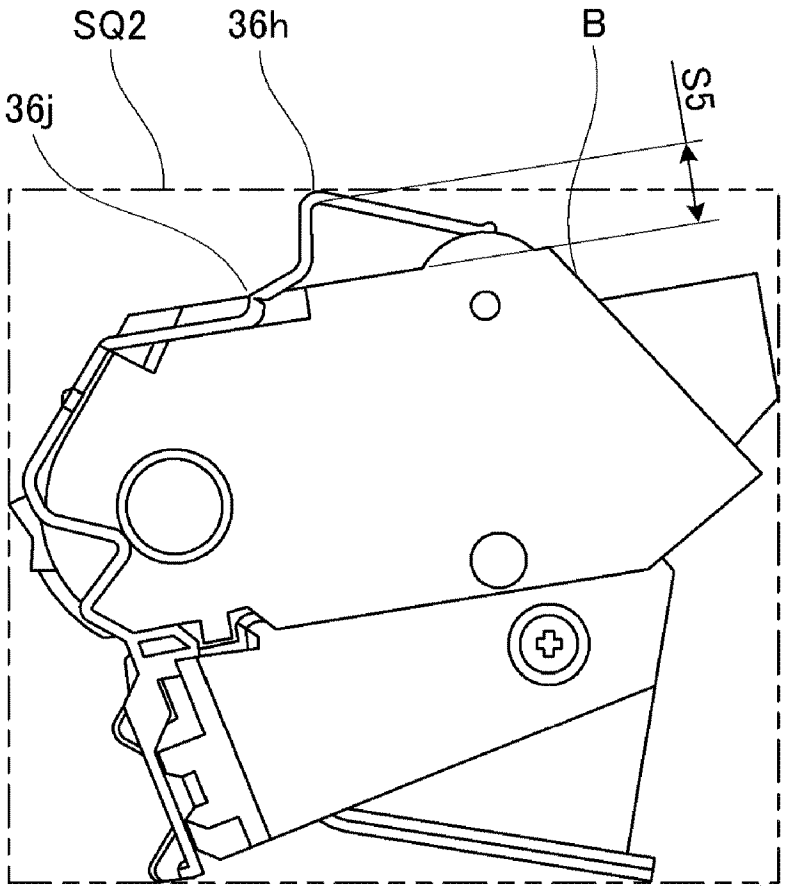
FIG. 9A and FIG. 9B are each an explanatory diagram of attitude (shape) deformation of a grip portion of a separation holding member according to the embodiment of the present invention.
Figure 9A:
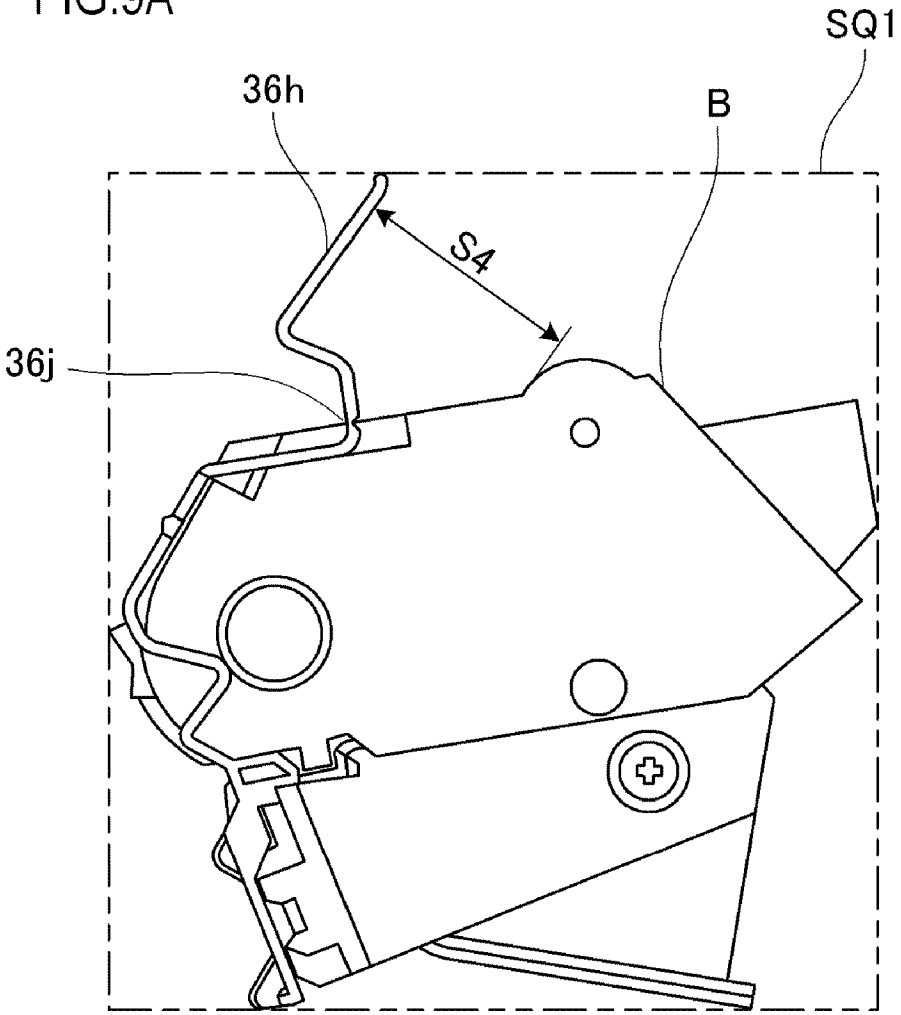
Figure 12A:
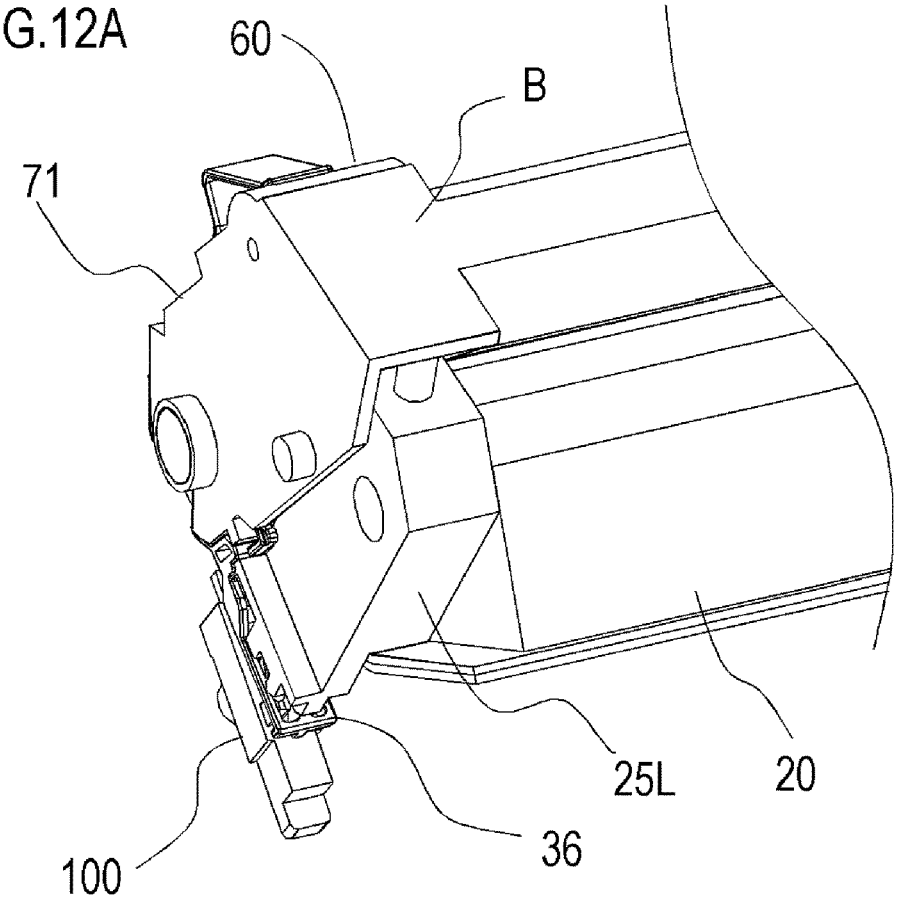
FIG. 12A to FIG. 12C are each an explanatory diagram of a separation holding member and a communication unit of an apparatus main body according to the embodiment of the present invention.
Figure 12B:
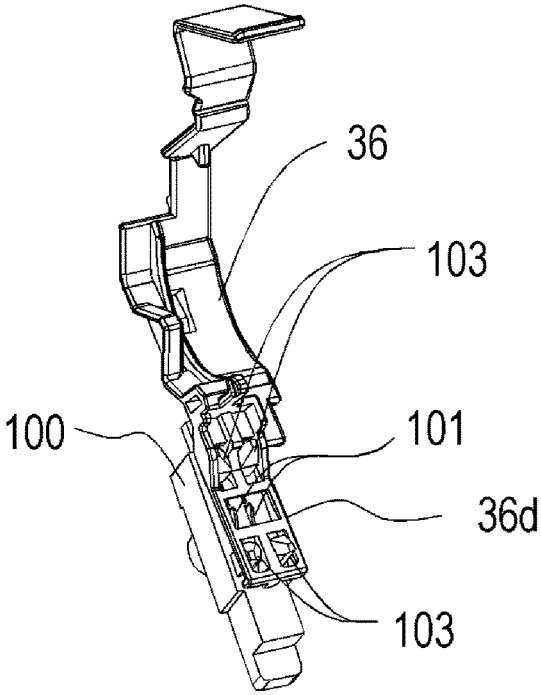
Figure 12C:
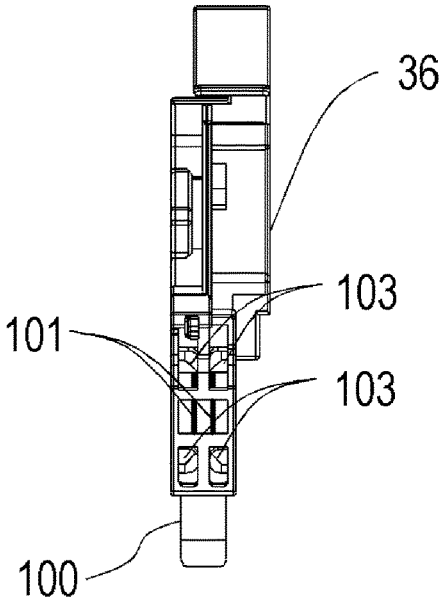

The non-driven side separation holding member 36 and the driven side separation holding member 37 according to the embodiment of the present invention will now be described with reference to FIGS. 4A and 4B to FIGS. 9A and 9B, and FIGS. 12A to 12C. FIG. 4A is a schematic perspective view showing a configuration of the cartridge B in a state where the non-driven side separation holding member 36 and the driven side separation holding member 37 are attached or, in other words, the cartridge unit. FIG. 4B is a schematic perspective view showing a configuration of the cartridge B in a state where the non-driven side separation holding member 36 and the driven side separation holding member 37 are not attached. FIG. 5A is a schematic perspective view of the non-driven side separation holding member 36 from an outer side in the longitudinal direction and a side of a surface that opposes the cartridge B. FIG. 5B is a schematic perspective view showing a rear surface of the non-driven side separation holding member 36 shown in FIG. 5A. FIG. 6 is a schematic side view showing a configuration of the cartridge unit in a direction of an arrow Hb in FIG. 4A. FIG. 7 is a schematic perspective view showing a schematic configuration of the apparatus main body A in a state where a cartridge door (an opening/closing member) has been opened to allow the cartridge B to be inserted or extracted and is also a diagram showing a position of a cross section H1. FIG. 8 is a schematic partial sectional view showing a part of a configuration in a direction of an arrow H1 in FIG. 7 in a state where the cartridge B to which the non-driven side separation holding member 36 and the driven side separation holding member 37 have been attached (the cartridge unit) is housed in the apparatus main body A. FIG. 9A and FIG. 9B are each a schematic side view showing a situation of a state change (an attitude change) of the non-driven side separation holding member 36 (a grip portion 36*h*) in the cartridge unit in the direction of the arrow Hb in FIG. 4A, in which FIG. 9A shows a first attitude (shape) and FIG. 9B shows a second attitude (shape). FIG. 12A is a schematic perspective view showing a configuration in a vicinity of the communication unit 100 in a state where the cartridge B to which the non-driven side separation holding member 36 and the driven side separation holding member 37 have been attached (the cartridge unit) is housed in the apparatus main body A. FIG. 12B is a schematic perspective view showing only the communication unit 100 and the non-driven side separation holding member 36 shown in FIG. 12A. FIG. 12C is a schematic view of the communication unit 100 shown in FIG. 12B as viewed from a direction opposing the communication unit 100.

Figure 4A:
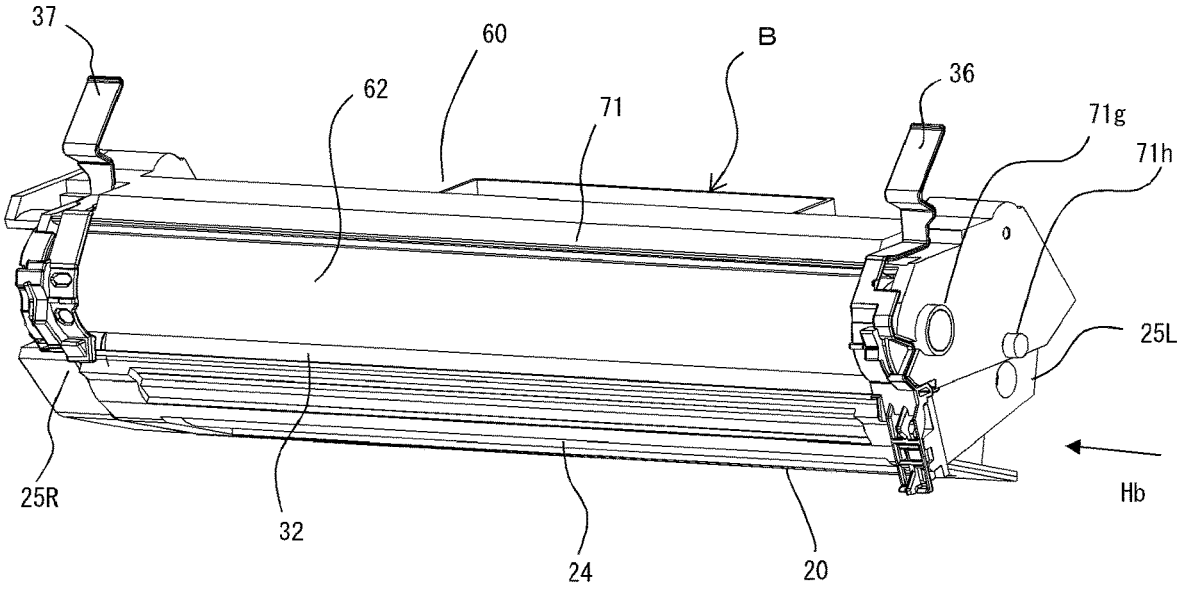
FIG. 4A and FIG. 4B are each an explanatory diagram of a cartridge unit according to the embodiment of the present invention.
Figure 4B:
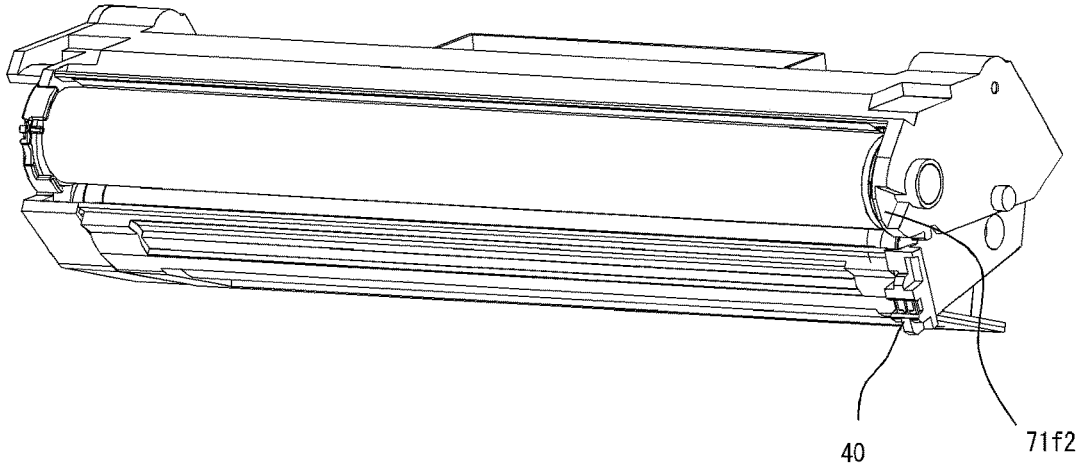

As shown in FIG. 4A, the non-driven side separation holding member 36 is arranged at a non-driven side end which is a side of one end of the cartridge B in a rotational axis direction of the photosensitive drum 62, and the driven side separation holding member 37 is arranged at a driven side end which is a side of the other end of the cartridge B. Accordingly, compared to when the non-driven side and the driven side are joined to create an integrated separation holding member, sizes of the non-driven side separation holding member 36 and the driven side separation holding member 37 may be minimized. Since the non-driven side separation holding member 36 and the driven side separation holding member 37 are symmetrically configured in the rotational axis direction of the photosensitive drum 62 and have approximately similar functions, hereinafter, the non-driven side separation holding member 36 will be described as an example and a description of the driven side separation holding member 37 will be omitted.

As shown in FIG. 5A and FIG. 5B, the non-driven side separation holding member 36 is configured so as to have a shape which straddles the cleaning unit 60 and the developing unit 20 or, in other words, configured so as to have a portion to be attached to the cleaning unit 60 and a portion to be attached to the developing unit 20. Specifically, the non-driven side separation holding member 36 is constituted by an attaching portion 36*a*, a first separation portion 36*b*, a second separation portion 36*c*, a third separation portion 36*d*, and the grip portion 36*h*. The first separation portion 36*b* is a portion which provides separation between the photosensitive drum 62 and the developing roller 32. The second separation portion 36*c* is a portion which provides separation between the photosensitive drum 62 and the transfer roller 7. The third separation portion 36*d* is a portion which provides separation between the storage element 40 and the communication unit 100.

As shown in FIG. 6, as the first inserted portion, the first separation portion 36*b* is inserted and sandwiched between the cleaning unit 60 and the developing unit 20. Specifically, the first separation portion 36*b* is inserted between an abutment portion 71*d* of the cleaning frame body 71 of the cleaning unit 60 and the abutment portion 25Lc of the side cover 25L of the developing unit 20. At this point, the first separation portion 36*b* moves the developing unit 20 in a direction opposite to a rotation direction M1 around the axis L2 against the biasing force F1 (refer to FIG. 3B) of the biasing member 46L. Accordingly, the developing roller 32 is arranged at a position (a retracted position) where the developing roller 32 has receded from a position during image formation (the development-enabled position) with respect to the photosensitive drum 62. At the same time, a rotational moment (refer to FIG. 3B) in the direction of an arrow M1 acts on the first separation portion 36*b* and a state is created where the first separation portion 36*b* is sandwiched between the abutment portion 71*d* of the cleaning frame body 71 and the abutment portion 25Lc of the side cover 25L. At this point, a clearance S1 (refer to FIG. 6) which is a position where the developing roller 32 has receded from the position during image formation with respect to the photosensitive drum 62 is secured between the photosensitive drum 62 and the developing roller 32.

As the second inserted portion, the second separation portion 36*c* is shaped so as to cause the transfer roller 7 arranged in the apparatus main body A to be arranged at a position where the transfer roller 7 has receded from a position during image formation (a relative position where a developer image can be transferred to a recording material) with respect to the photosensitive drum 62. In a state where the cartridge B to which the non-driven side separation holding member 36 (and the driven side separation holding member 37) has been attached is housed in the apparatus main body A, as shown in FIG. 8, the second separation portion 36*c* biases a bearing portion 110 of the transfer roller 7 against a biasing force Ft of a biasing member (a compression spring) 111. At this point, a clearance S2 which is a position where the transfer roller 7 has receded from the position during image formation with respect to the photosensitive drum 62 is secured between the photosensitive drum 62 and the transfer roller 7.

As the third inserted portion, the third separation portion 36*d* is arranged so as to cover the storage element 40 attached to the side cover 25L of the developing unit 20 as shown in FIG. 6. The third separation portion 36*d* is provided with two ribs 36*d*1. The apparatus main body A is provided with the communication unit 100 that is biased by the biasing member (a compression spring) 102 such that the communication unit 100 is capable of advancing and retreating with respect to the position where the storage element 40 is arranged in a state where the cartridge B is mounted to the apparatus main body A. In a state where the cartridge B to which the non-driven side separation holding member 36 has been attached is housed in the apparatus main body A, as shown in FIG. 8, the ribs 36*d*1 of the third separation portion 36*d* bias the communication unit 100 provided in the apparatus main body A in a direction counter to a biasing force Fph of the biasing member 102. In addition, in the state where the first separation portion 36*b* is sandwiched between the abutment portion 71*d* of the cleaning frame body 71 and the abutment portion 25Lc of the side cover 25L, the side cover 25L is at a position having rotated in a direction opposite to the rotation direction M1 from the position during image formation. Therefore, the communication contact portion 101 is arranged at a position receded from a position during image formation (a relative position where communication can be performed with the communication unit 100). In this state, the third separation portion 36*d* is arranged between the storage element 40 and the communication unit 100 provided in the apparatus main body A. At this point, a clearance S3 is secured which prevents the communication contact portion 101 and the storage element 40 from coming into contact with each other. In addition, as shown in FIGS. 12B and 12C, the third separation portion 36*d* has openings at positions corresponding to the projected portion 103 and the communication contact portion 101 provided on the communication unit 100. By being opened at a position corresponding to the communication contact portion 101, the non-driven side separation holding member 36 is also prevented from coming into contact with the communication contact portion 101 and the storage element 40. By being opened at a position corresponding to the projected portion 103, the non-driven side separation holding member 36 and the projected portion 103 are prevented from interfering with each other when securing a necessary and sufficient clearance S3. In other words, the non-driven side separation holding member 36 is assembled to the communication unit 100 so that the ribs 36*d*1 and the like come into contact with portions other than the projected portion 103 but do not come into contact with the projected portion 103. Accordingly, the clearance S3 is prevented from becoming excessive. Furthermore, by configuring the opening at a position corresponding to the projected portion 103 in a similar manner to the guiding portion 41 of the cartridge B, the non-driven side separation holding member 36 assists positioning of the communication unit 100.

An attaching portion a of the non-driven side separation holding member 36 with respect to the cartridge B is constituted by a first attaching portion 36*a*1, a second attaching portion 36*a*2, a third attaching portion 36*a*3, and a fourth attaching portion 36*a*4.

The first attaching portion 36*a*1 and the second attaching portion 36*a*2 are configured in a claw shape as shown in FIG. 5A and FIG. 5B. In addition, as shown in FIG. 6, the first attaching portion 36*a*1 comes into contact with (is hooked on) an attaching portion 71*e* of the cleaning frame body 71 in a state where the first separation portion 36*b* is sandwiched between the abutment portion 71*d* of the cleaning frame body 71 and the abutment portion 25Lc of the side cover 25L. At the same time, the second attaching portion 36*a*2 comes into contact with (is hooked on) an attaching portion 71*j* of the cleaning frame body 71. Accordingly, the non-driven side separation holding member 36 is prevented from detaching from the cartridge B. While the first attaching portion 36*a*1 and the second attaching portion 36*a*2 are configured in a claw shape in the present embodiment, alternatively, the attaching portion 71*e* or the attaching portion 71*j* of the cleaning frame body 71 may be configured in a claw shape.

As shown in FIG. 5A and FIG. 5B, the third attaching portion 36*a*3 and the fourth attaching portion 36*a*4 respectively constitute approximately parallel walls that extend in a direction approximately perpendicular to a rotational axis direction of the photosensitive drum 62 and are arranged so as to oppose the rotational axis direction of the photosensitive drum 62. Meanwhile, as shown in FIG. 4B, the cartridge B is provided with a restricting portion 71*f*2 which extends (protrudes) in a direction perpendicular to the rotational axis L0 of the photosensitive drum 62 of the cleaning frame body 71 as a protruding portion at a non-driven side end in the direction of the rotational axis L0. When the non-driven side separation holding member 36 is attached to the cartridge B, the third attaching portion 36*a*3 and the fourth attaching portion 36*a*4 as concave restricted portions are arranged so as to sandwich the restricting portion 71*f*2 in the direction of the rotational axis L0. Accordingly, a position of the non-driven side separation holding member 36 in the direction of the rotational axis L0 with respect to the cartridge B is restricted.

The non-driven side separation holding member 36 is configured so as to be inclinable and deformable such that, when an external force is applied, a side of the grip portion 36*h* bends with respect to a holding member main body constituted by the attaching portion 36*a* and the first to third separation portions 36*b*, 36*c*, and 36*d* with a deforming portion (a thin-walled portion) 36*j* as a base point. The non-driven side separation holding member 36 is configured so that, due to the deformation, the grip portion 36*h* may assume an erected attitude (FIG. 9A) and a prostrate attitude (FIG. 9B) with respect to the cartridge B in a state where the non-driven side separation holding member 36 is attached to the cartridge B. In the following description, the attitude of the non-driven side separation holding member 36 shown in FIG. 9A will be referred to as a natural attitude and the attitude of the non-driven side separation holding member 36 shown in FIG. 9B will be referred to as a housed attitude.

In a state where the cartridge B to which the non-driven side separation holding member 36 has been attached (the cartridge unit) is not housed in the apparatus main body A, the non-driven side separation holding member 36 assumes the natural attitude shown in FIG. 9A. In other words, the grip portion 36*h* of the non-driven side separation holding member 36 assumes an erected attitude (the first attitude) in which the grip portion 36*h* protrudes in a direction of separation from a surface of the cartridge B (an upper surface of the cleaning frame body 71). The non-driven side separation holding member 36 in the natural attitude is configured such that a clearance S4 (a gap) which is larger than the fingers of a user is secured between the surface of the cartridge B (the cleaning frame body 71) and the grip portion 36*h*. In this case, as shown in FIG. 6, the user can insert a finger between the grip portion 36*h* and the upper surface of the cleaning frame body 71 and readily detach the non-driven side separation holding member 36 from the cartridge B by lifting up the grip portion 36*h* in a direction of an arrow U.

On the other hand, the non-driven side separation holding member 36 in the housed attitude shown in FIG. 9B is configured such that a clearance S5 (a gap) which is smaller than the clearance S4 in the natural attitude is formed between the cartridge B and the grip portion 36*h*. Specifically, the grip portion 36*h* of the non-driven side separation holding member 36 assumes a prostrate attitude (the second attitude) with respect to the surface of the cartridge B (the upper surface of the cleaning frame body 71) and a height from the surface of the cartridge B is reduced as compared to when the grip portion 36*h* is in the erected attitude. At this point, an area SQ2 of a rectangle that connects an outermost projected shape including the cartridge B and the non-driven side separation holding member 36 is smaller than SQ1 when the non-driven side separation holding member 36 assumes the natural attitude due to a reduced degree of protrusion (a height) of the grip portion 36*h* from the surface of the cartridge B. Accordingly, a capacity inside the apparatus main body A which is required when housing the cartridge B to which the non-driven side separation holding member 36 has been attached in the apparatus main body A can be reduced.

Since the driven side separation holding member 37 is similar to the non-driven side separation holding member 36 with the exception of not having the third separation portion 36*d*, a description thereof will be omitted.

Figure 10A:
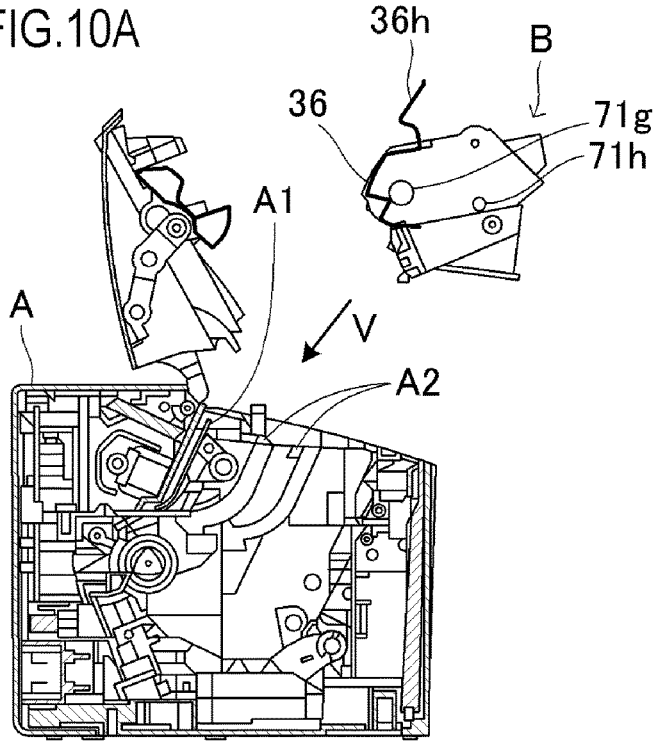
FIG. 10A to FIG. 10C are each an explanatory diagram of insertion/extraction of a cartridge unit into/from an apparatus main body according to the embodiment of the present invention.
Figure 10B:
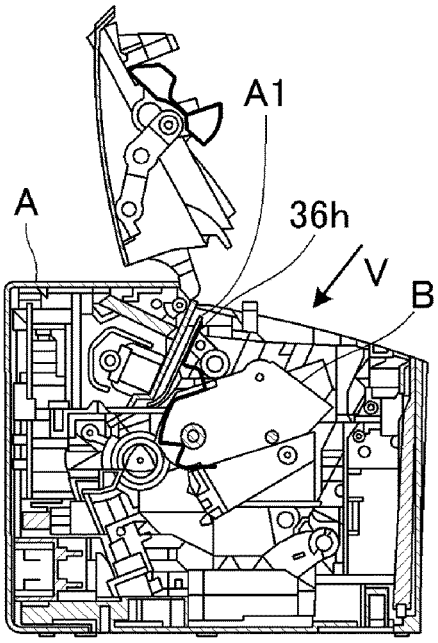
Figure 10C:
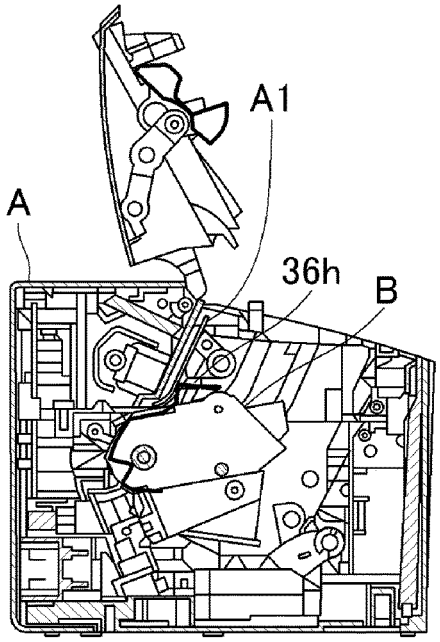

(4) Description of Situation of Insertion/Extraction of Cartridge B Mounted with Non-driven Side Separation Holding Member 36 (Cartridge Unit) Into/From Apparatus Main Body A A situation of insertion/extraction of the cartridge B mounted with the non-driven side separation holding member 36 and the driven side separation holding member 37 (the cartridge unit) according to the embodiment of the present invention into/from the apparatus main body A will now be described with reference to FIG. 7 and FIGS. 10A to 10C. FIGS. 10A to 10C are, respectively, sectional explanatory diagrams representing a view of an arrow H1 in FIG. 7. FIG. 10A shows a state where the cartridge B mounted with the non-driven side separation holding member 36 (the cartridge unit) is outside of the apparatus main body. FIG. 10B shows a state in the midst of attaching/detaching the cartridge B mounted with the non-driven side separation holding member 36 (the cartridge unit) to/from the apparatus main body A. FIG. 10C shows a state where the cartridge B mounted with the non-driven side separation holding member 36 (the cartridge unit) has been inserted into the apparatus main body A. It should be noted that, since the non-driven side separation holding member 36 and the driven side separation holding member 37 have approximately similar functions, hereinafter, the non-driven side separation holding member 36 will be described as an example and a description of the driven side separation holding member 37 will be omitted.

As shown in FIG. 7, the apparatus main body A is provided with a guide A2 which regulates an insertion/extraction trajectory of the cartridge B. The guide A2 is provided in pairs on respectively the driven side and the non-driven side of the apparatus main body A with respect to the cartridge B, and each pair is arranged so as to oppose the rotational axis direction of the photosensitive drum 62. The guides A2 have a groove-like shape, and the insertion/extraction trajectory is regulated as the guides A2 engage with convex shapes 71*g* and 71*h* provided on the non-driven side side surface of the cartridge B. The driven side is also provided with driven side guides A2 and components similar to the convex shapes 71*g* and 71*h* (not shown) and a rotation attitude of the cartridge B during insertion/extraction is regulated.

As shown in FIG. 10A, a housing portion of the cartridge B (the cartridge unit) in the apparatus main body A is provided with an abutment portion A1. The abutment portion A1 is provided midway along the trajectory in which the cartridge B mounted with the non-driven side separation holding member 36 (the cartridge unit) is inserted into the apparatus main body A at a position where the abutment portion A1 interferes with the grip portion 36*h*.

As shown in FIG. 10B, the cartridge B to which the non-driven side separation holding member 36 has been attached (the cartridge unit) is inserted into the apparatus main body A in a direction of an arrow V from an opening. As the convex portions 71*g* and 71*h* of the cartridge B engage the guides A2 to guide the cartridge B to a housed position, the grip portion 36*h* comes into contact with the abutment portion A1. When the cartridge B is further inserted toward the housed position (a mounting completion position) of the apparatus main body from this state, the grip portion 36*h* of the separation holding member 36 is pushed against the abutment portion A1. Accordingly, the grip portion 36*h* elastically deforms from a detached attitude (the erected attitude) to a housed attitude (the prostrate attitude) with the thin-walled deforming portion 36*j* as a base point. The abutment portion A1 is arranged at a position and in a shape which enables the deformation of the grip portion 36*h* to be completed before the insertion of the cartridge B into the apparatus main body A is completed (before the cartridge unit reaches the mounting completion position). While the cartridge B is at the mounted position (the mounting completion position) of the apparatus main body A, the grip portion 36*h* is pressed against the abutment portion A1 and thereby held in the housed attitude.

A case where the cartridge B to which the non-driven side separation holding member 36 has been attached (the cartridge unit) is extracted from the apparatus main body A will now be described. During extraction, as the cartridge B (the cartridge unit) is moved along the guides A2 in an opposite direction to during insertion, the pressing force from the abutment portion A1 is removed. Accordingly, the non-driven side separation holding member 36 deforms to the normal attitude (the natural attitude) shown in FIG. 9A due to the elastic restorative force of the non-driven side separation holding member 36. As a result, the grip portion 36*h* assumes the erected attitude with respect to the cartridge B and increases an amount of protrusion (a height) from the surface of the cartridge B. Therefore, the user can more readily grip the grip portion 36*h* of the non-driven side separation holding member 36 and remove the non-driven side separation holding member 36 from the cartridge B without increasing a capacity of a region of the apparatus main body A for housing the cartridge B (the cartridge unit).

While the elastic restorative force of the non-driven side separation holding member 36 is used as a generation source of a biasing force which causes the non-driven side separation holding member 36 to deform from the housed attitude to the detached attitude in the present embodiment, a configuration may be adopted in which a separate biasing member such as a spring is used instead. While a configuration in which only the grip portion **36*h* deforms with the deforming portion 36*j* of the non-driven side separation holding member 36 as a base point has been adopted, a configuration may be adopted in which the entire non-driven side separation holding member 36 deflects and deforms without providing the deforming portion 36*j*** or the number of base points of deformation may be increased.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-008712, filed on Jan. 23, 2018, which is hereby incorporated by reference herein in its entirety.

What is claimed is:

1. A separation holding member mounted to a cartridge attachable to and detachable from an apparatus main body of an image forming apparatus, the separation holding member being provided with the cartridge including an image bearing member and a developer bearing member the separation holding member comprising:

an inserted portion which is inserted between a first frame body which supports the image bearing member and a second frame body which supports the developer bearing member and which holds a relative position of the first frame body and the second frame body where the image bearing member and the developer bearing member do not come into contact with each other, the first frame body and the second frame body being provided in the cartridge; and a grip portion for detaching the inserted portion from between the first frame body and the second frame body, wherein the separation holding member is attached to the cartridge along a surface of a frame body of the cartridge around a rotational axis of the image bearing member, wherein the inserted portion and the grip portion are formed integrally with each other, and wherein the grip portion is configured so as to assume a first shape of protruding in a direction of separation from a surface of the cartridge mounted with the separation holding member when the cartridge mounted with the separation holding member is detached from the apparatus main body, the first shape being caused by an elastic deformation of the separation holding member and a distance between an end of the grip portion in the first shape and the surface of the cartridge being a first distance, and assume a second shape in which the distance between the end of the grip portion and the surface of the cartridge is a second distance which is smaller than the first distance when the cartridge mounted with the separation holding member is mounted to the apparatus main body, the second shape being caused by an elastic deflection of the separation holding member, the elastic deflection being caused by abutting of a part of the separation holding member against the apparatus main body.

2. The separation holding member according to claim 1, wherein the first shape is a shape in which the grip portion is erected with respect to the surface of the cartridge, and wherein the second shape is a shape in which the grip portion is prostrated with respect to the surface of the cartridge.

3. The separation holding member according to claim 1, wherein the grip portion has a thin-walled portion and configured so as to change from the first shape to the second shape by an inclined deformation with the thin-walled portion as a base point.

4. The separation holding member according to claim 1, wherein when the cartridge mounted with the separation holding member is detached from the apparatus main body, the grip portion moves along a moving direction of the inserted portion when the inserted portion is removed from between the first frame body and the second frame body, and is to be in the first shape of protruding in the direction from the surface of the cartridge mounted with the separation holding member, the distance between the end of the grip portion in the first shape and the surface of the cartridge is the first distance, and the movement and the first shape of the grip portion are caused by an elastic deformation of the separation holding member.

5. A cartridge unit attachable to and detachable from an apparatus main body of an image forming apparatus, the cartridge unit comprising:

a cartridge including an image bearing member on which an electrostatic latent image is formed, a developer bearing member which develops the electrostatic latent image formed on the image bearing member with a developer, a first frame body which supports the image bearing member, a second frame body which supports the developer bearing member and which is relatively movable with respect to the first frame body, a biasing member which biases the first frame body and the second frame body so as to relatively move the first frame body and the second frame body from a retracted position where the image bearing member and the developer bearing member do not come into contact with each other to a development-enabled position where the developer bearing member is capable of developing the electrostatic latent image formed on the image bearing member, and a storage element which is capable of coming into contact with a communication contact portion of a communication unit provided in the apparatus main body and communicating with the communication unit; and a separation holding member including an inserted portion which is inserted between the first frame body which supports the image bearing member and the second frame body which supports the developer bearing member and which holds a relative position of the first frame body and the second frame body where the image bearing member and the developer bearing member do not come into contact with each other, the first frame body and the second frame body being provided in the cartridge; and a grip portion for detaching the inserted portion between the first frame body and the second frame body, wherein the separation holding member is attached to the cartridge along a surface of a frame body of the cartridge around a rotational axis of the image bearing member, wherein the inserted portion and the grip portion are formed integrally with each other, and wherein the grip portion is configured so as to assume a first shape of protruding in a direction of separation from a surface of the cartridge mounted with the separation holding member when the cartridge mounted with the separation holding member is detached from the apparatus main body, the first shape being caused by an elastic deformation of the separation holding member and a distance between an end of the grip portion in the first shape and the surface of the cartridge being a first distance, and assume a second shape in which the distance between the end of the grip portion and the surface of the cartridge is a second distance which is smaller than the first distance when the cartridge mounted with the separation holding member is mounted to the apparatus main body, the second shape being caused by an elastic deflection of the separation holding member which is caused by abutting of a part of the separation holding member against the apparatus main body.

6. An image forming apparatus, comprising:

a cartridge including an image bearing member on which an electrostatic latent image is formed, a developer bearing member which develops the electrostatic latent image formed on the image bearing member with a developer, a first frame body which supports the image bearing member, a second frame body which supports the developer bearing member and which is relatively movable with respect to the first frame body, a biasing member which biases the first frame body and the second frame body so as to relatively move the first frame body and the second frame body from a retracted position where the image bearing member and the developer bearing member do not come into contact with each other to a development-enabled position where the developer bearing member is capable of developing the electrostatic latent image formed on the image bearing member, and a storage element which is capable of coming into contact with a communication contact portion of a communication unit provided in an apparatus main body of the image forming apparatus and communicating with the communication unit;

a separation holding member including an inserted portion which is inserted between the first frame body which supports the image bearing member and the second frame body which supports the developer bearing member and which holds a relative position of the first frame body and the second frame body where the image bearing member and the developer bearing member do not come into contact with each other, the first frame body and the second frame body being provided in the cartridge; and a grip portion for detaching the inserted portion between the first frame body and the second frame body, wherein the separation holding member is attached to the cartridge along a surface of a frame body of the cartridge around a rotational axis of the image bearing member, wherein the inserted portion and the grip portion are formed integrally with each other, and wherein the grip portion is configured so as to assume a first shape of protruding in a direction of separation from a surface of the cartridge mounted with the separation holding member when the cartridge mounted with the separation holding member is detached from the apparatus main body, the first shape being caused by an elastic deformation of the separation holding member and a distance between an end of the grip portion in the first shape and the surface of the cartridge being a first distance, and assume a second shape in which the distance between the end of the grip portion and the surface of the cartridge is a second distance which is smaller than the first distance when the cartridge mounted with the separation holding member is mounted to the apparatus main body, the second shape being caused by an elastic deflection of the separation holding member which is caused by abutting of a part of the separation holding member against the apparatus main body; and wherein the apparatus main body includes a transfer member which forms a nip between the image bearing member and the transfer member and which transfers a developer image formed on the image bearing member to a recording material supplied to the nip, the communication unit, and an abutment portion which abuts against the grip portion when the cartridge mounted with the separation holding member is mounted to the apparatus main body and which causes the grip portion to change from the first shape to the second shape.

7. A separation holding member mounted to a cartridge attachable to and detachable from an apparatus main body of an image forming apparatus, the separation holding member being mounted so as to hold a first frame body which supports an image bearing member and a second frame body which supports a developer bearing member at a relative position where the image bearing member and the developer bearing member do not come into contact with each other, the first frame body and the second frame body being provided in the cartridge, the separation holding member comprising:

a grip portion for detaching the separation holding member from the cartridge, the grip portion being configured so as to assume a first shape of protruding in a direction of separation from a surface of the cartridge when the cartridge mounted with the separation holding member is detached from the apparatus main body, and assume a second shape in which a gap with the surface of the cartridge is smaller than in the first shape when the cartridge mounted with the separation holding member is mounted to the apparatus main body, wherein the first frame body and the second frame body are configured so as to be relatively movable to a retracted position that is a relative position where the image bearing member and the developer bearing member do not come into contact with each other, and a development-enabled position that is a relative position where the developer bearing member is capable of developing an electrostatic latent image formed on the image bearing member, and wherein the separation holding member is provided on a side of one end of the first frame body in a rotational axis direction of the image bearing member, the separation holding member further comprising:

an inserted portion which is inserted between the first frame body and the second frame body and which holds a relative position of the first frame body and the second frame body to the retracted position; and concave restricted portions between which a protruding portion that protrudes from the first frame body in a direction intersecting the rotational axis direction is arranged in the rotational axis direction.

8. The separation holding member according to claim 7, further comprising an attaching portion to be attached to the first frame body, wherein the restricted portion is positioned between the attaching portion and the inserted portion around the rotational axis.

9. The separation holding member according to claim 7, further comprising, when defining the inserted portion as a first inserted portion, a second inserted portion which is inserted between the cartridge and the apparatus main body in a state where the cartridge is mounted to the apparatus main body and which holds the image bearing member and a transfer member provided in the apparatus main body in a state of being separated from a relative position where a developer image formed on the image bearing member can be transferred to a recording material.

10. The separation holding member according to claim 9, wherein the restricted portion and the second inserted portion are arranged at mutually overlapping positions in the rotational axis direction.

11. The separation holding member according to claim 7, further comprising, when defining the inserted portion as a first inserted portion, a third inserted portion which is inserted between the cartridge and the apparatus main body in a state where the cartridge is mounted to the apparatus main body and which holds a communication contact portion provided in the second frame body and a communication unit provided in the apparatus main body in a state of being separated from a relative position where the communication contact portion comes into contact with a contact of the communication unit such that communication with the communication unit can be performed.

* * * * *